US005499637A

United States Patent [19]

Foti

[11] Patent Number: 5,499,637

[45] Date of Patent: Mar. 19, 1996

[54] APPLICATOR FOR HAIR COLORING AND THE LIKE

[76] Inventor: Anthony Foti, 4 Sailer Ct., Elizabeth, N.J. 07201

[21] Appl. No.: 354,667

[22] Filed: Dec. 13, 1994

[51] Int. Cl.[6] ..... A45D 24/00; A46B 5/02

[52] U.S. Cl. ..... 132/200; 132/112; 132/212; 132/116; 15/160; 15/145

[58] Field of Search ..... 132/112, 212, 132/200, 116; 15/143.1, 145, 159.1, 160, 246

[56] References Cited

U.S. PATENT DOCUMENTS 1,752,400 4/1930 Sund ..... 15/246
4,157,598 6/1979 Talent et al. ..... 15/145
4,813,439 3/1989 Morgan ..... 132/116
5,042,512 8/1991 Knight ..... 132/212
5,293,661 3/1994 Appleby ..... 15/145

*Primary Examiner*—John G. Weiss
*Assistant Examiner*—Pedro Philogene
*Attorney, Agent, or Firm*—Jeffrey I. Kaplan

[57] ABSTRACT

An improved applicator brush provides a tapered handle portion for lifting and separating hair, and a plurality of bristles emanating perpendicularly therefrom. In one embodiment, the brush is formed by connecting a conventional applicator brush through a bore in a tapered handle in order to form the perpendicular connection.

6 Claims, 4 Drawing Sheets

APPLICATOR FOR HAIR COLORING AND THE LIKE

TECHNICAL FIELD

This invention relates to cosmetology, and more particularly, to an improved apparatus for the application of hair coloring and the like by, for example, a beautician.

DESCRIPTION OF THE PRIOR ART

The application of hair coloring has been performed using the same basic technique for many years. One typical technique is to utilize an applicator brush that is exemplified by brush 101 of FIG. 1. The brush includes a handle portion 102 having a pointed tail 103 and a plurality of bristles 104. Prior to utilization of the prior art device of FIG. 1, the hair is typically brushed out.

In operation, a beautician grips the applicator brush at 102 and uses pointed tail 103 to lift and separate sections of hair. After a section is lifted, applicator brush 101 is then twisted again so that the bristles 104 may be used to apply the hair color or similar such substance.

There are several problems with the prior art applicator brush as exemplified by FIG. 1. First, the motions of twisting from one side of the brush to the other in order to lift and separate the hair and then apply the hair color is awkward for the beautician. Moreover, the required actions often result in undesirable spills of the hair color, as well as the beautician getting the hair color on clothing, hands, or in other undesirable places. Consequently, the process is awkward, messy, and wasteful.

One prior art attempt at solving some of the above problems is described in U.S. Pat. No. 5,152,305 issued to Niv. In the Niv arrangement, the hair dye applicator includes a hollow tubular housing with a disposable plastic liner. The hair dye is placed within the disposable plastic liner and is dispensed from a nozzle included with the device. However, the Niv device is difficult to handle and quite expensive to manufacture, as well as having a different format from most brushes which beauticians are comfortable using.

In view of the above problems, it can be appreciated that there exists a need in the art for an inexpensive and simple to use applicator brush for hair color and the like.

SUMMARY OF THE INVENTION

The above and other problems of the prior art are overcome in accordance with the present invention which relates to an improved apparatus for the application of hair color and the like. In accordance with the invention, a tapered handle is provided which includes a bore therethrough at one end thereof. A conventional applicator brush is slid through the bore into a locking position which provides the conventional applicator with a perpendicular handle. The perpendicular handle is then used to lift and separate a section of hair and the bristles at the end of the applicator brush are utilized to apply the hair color. Twisting of the beautician's wrist is minimized.

By Utilizing a substantially perpendicular handle, the improved applicator brush is more comfortable and convenient for the beautician. Additionally, spillage and waste are eliminated or minimized.

An additional advantage of the invention is that by connecting the tapered handle to the applicator in different directions, the grip and feel of the improved applicator brush can be fitted to maximize use and comfort. Finally, an optional thumb screw allows further adjustment of the grip.

DETAILED DESCRIPTION OF TEE PREFERRED EMBODIMENT

Figure 1:
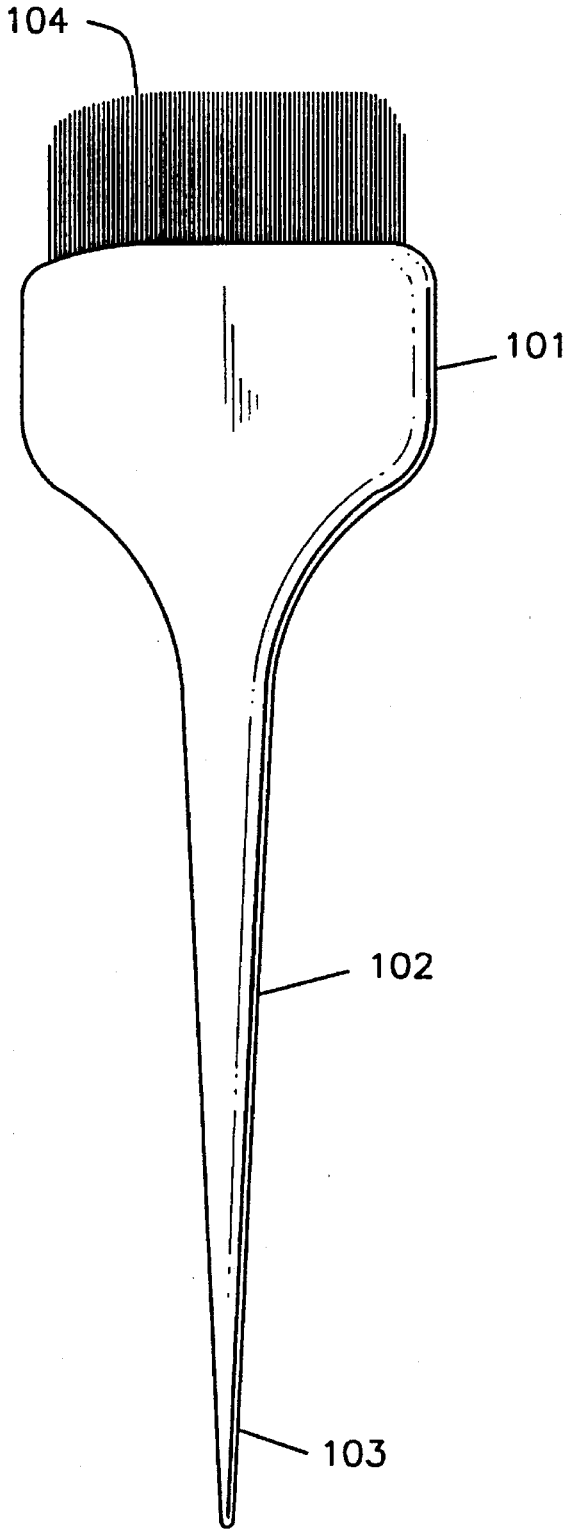
(PRIOR ART) FIG. 1
FIG. 1 is a prior art conventional applicator brush.
Figure 2:
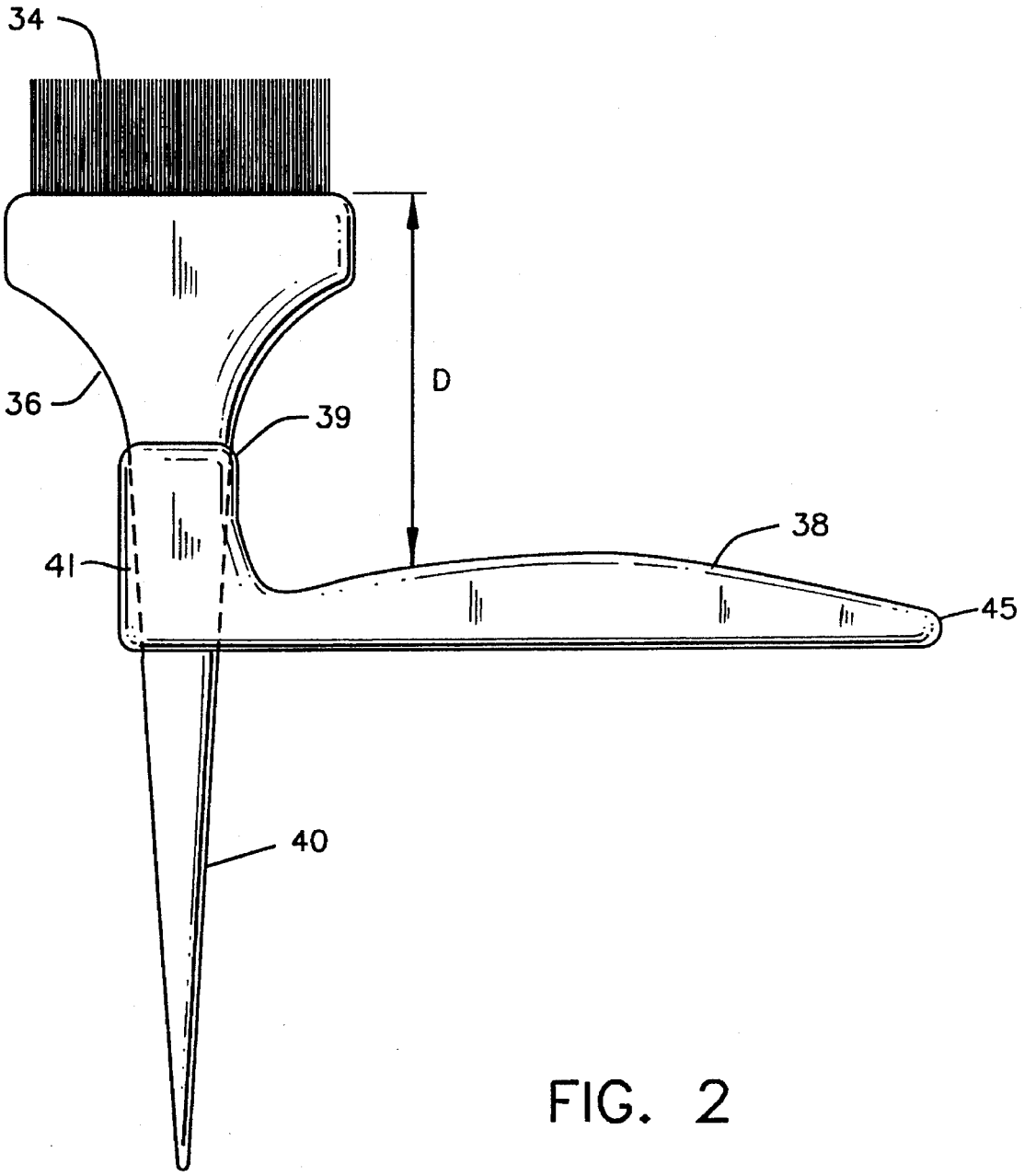
FIG. 2 denotes the applicator brush of FIG. 1 mounted within a tapered handle in accordance with the present invention.

FIG. 2 shows an exemplary embodiment of the present invention including a conventional applicator brush 36 inserted into tapered handle 38. The tapered handle 38 includes a bore 39 therethrough into which the applicator 36 is inserted as shown. The dotted portion 41 is intended to show portions of applicator brush 36 which are enclosed within bore 39.

Tapered handle 38 is referred to herein as a SLIDE PICK™. The combination of the SLIDE PICK™ and applicator brush 36 is termed herein an improved applicator brush.

In operation, the beautician uses the narrow end 45 of SLIDE PICK™ 38 in order to lift and separate sections of hair for application of hair color or the like. Bristles 34 of applicator 36 are then utilized to apply the hair color of similar such substance. The beautician grips the improved applicator brush by holding bored out gases of SLIDE PICK™ 38. The twisting of a beauticians wrist required to utilize narrow end 45 to separate hair, and then bristles 34 to apply the hair color, is a much more natural and easy movement than that is possible without use of SLIDE PICK™ 38. The portion of applicator brush 36 labeled 40, which was previously utilized to grip the device, is no longer needed for the purpose.

Figure 4:
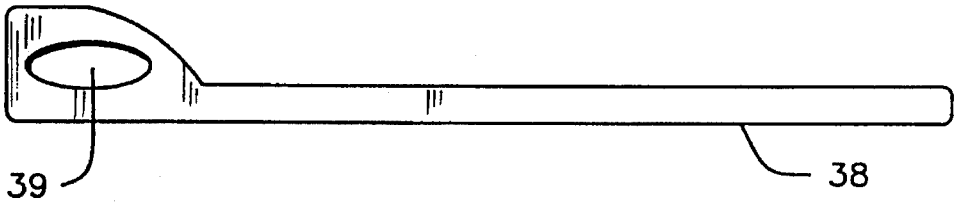
FIG. 4 indicates a top view of the tapered handle.
Figure 5:
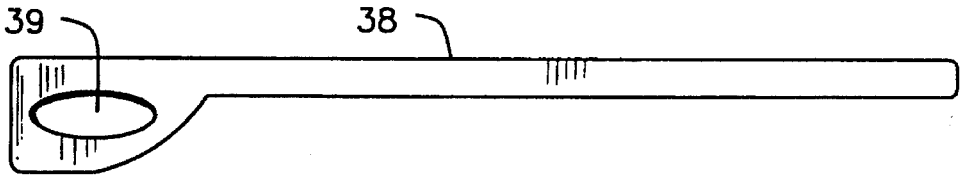
FIG. 5 depicts a bottom view of the tapered handle.

FIGS. 4 and 5 show a top and bottom view respectively of tapered handle 38. As shown in FIGS. 4 and 5, the bore 39 is shaped to coincide with the shape of the conventional applicator brush 36 so that when the applicator brush is pushed far enough into bore 39, the size of the applicator brush matches that of bore 39. Therefore, a frictional connection engages applicator brush 36 to the inside of bore 39.

It is also noted that the bore is symmetrical in that the applicator brush 36 may be placed into the tapered handle 38 from either the top or bottom. As shown from a comparison of FIGS. 2 and 3, whether applicator brush 36 is inserted into bore 39 from the top or bottom will determine the perpendicular distance D from the bristles 34 to SLIDE PICK™ 38. Thus, the user may the insert applicator brush from either the top or bottom, depending upon which distance is more comfortable for the individual's use.

It should be also be noted that bore 39 may be shaped differently in order to accommodate differently shaped handle portions 40. Additionally, while SLIDE PICK™ 38 has been made to allow for a conventional applicator brush 36 to be inserted therein and removed therefrom, it should also be noted that the device may be manufactured as a single integral part. The same advantages will be achieved as long as the portion 38 is sufficient for a user to grab while the bristles 34 protrude substantially perpendicular from, and near an end of, the device.

Figure 3:
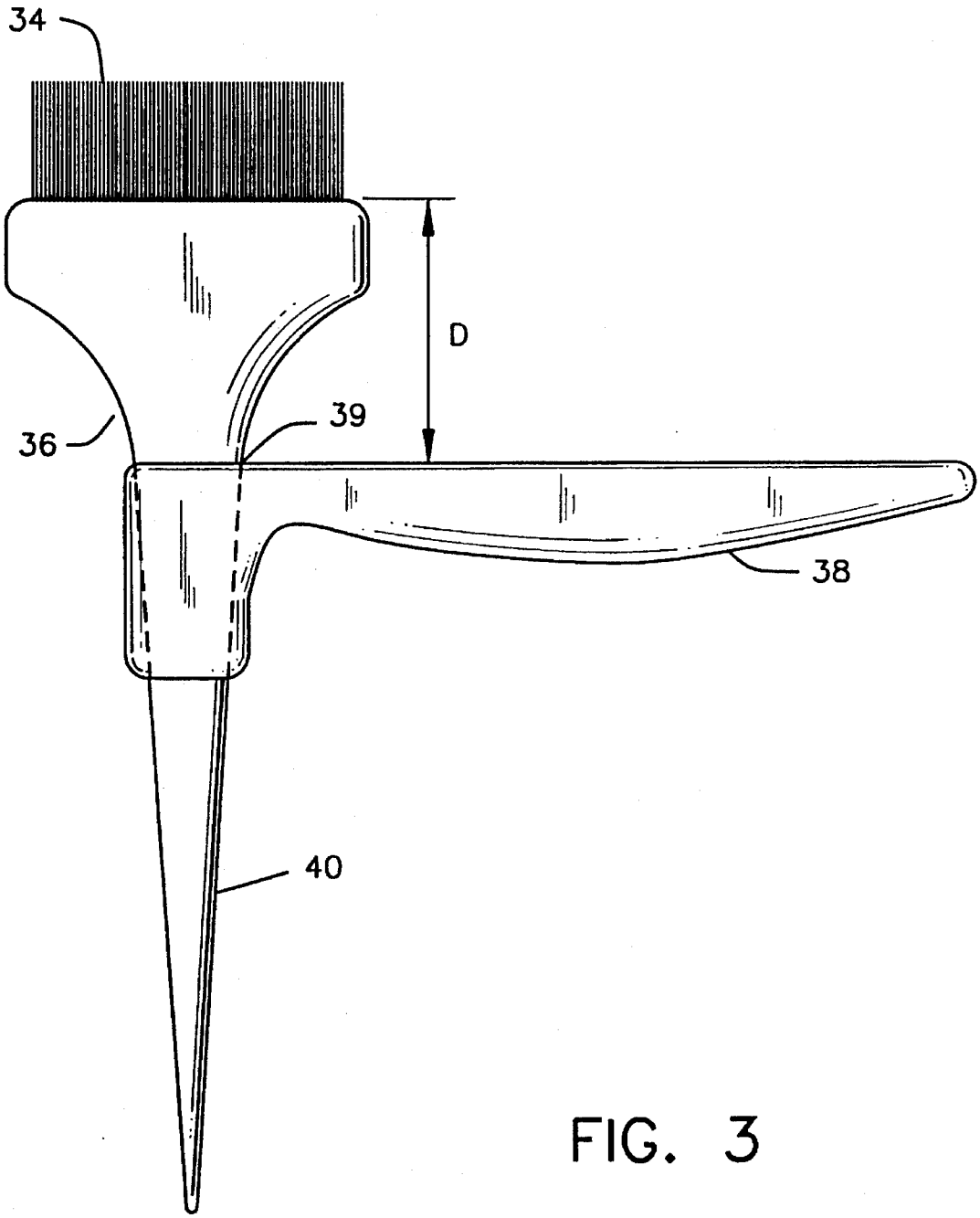
FIG. 3 shows the applicator brush mounted within the tapered handle at a different orientation to form a different type of fit.
Figure 6:
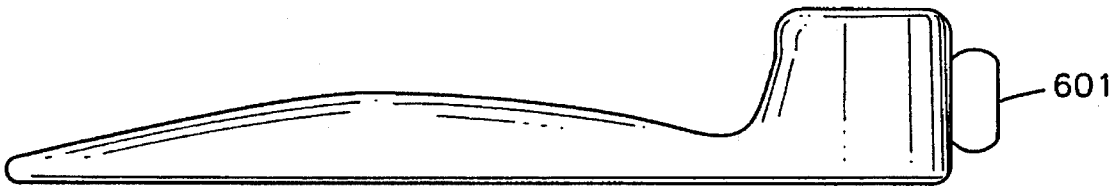
FIG. 6 depicts an optional thumb screw embodiment.

As a first optional enhancement, a thumb screw 601, as shown in FIG. 6, may be utilized. The thumb screw allows the applicator brush 36 to be a justibly engaged within the SLIDE PICK™ 38. To adjust the distance D, as shown in FIGS. 2 and 3, the thumb screw 601 may be tightened to lock the applicator brush in place. This provides for customizing the orientation of the improved applicator brush as much as possible.

While the above describes the preferred embodiment of the invention, it is understood that various modifications and/or additions may be made without departing from the spirit and scope thereof. It should be known that the particular shape of the SLIDE PICK™ may be varied as needed and the particular size and shape of the bore through the slide pick may also be varied. Additionally, the SLIDE PICK™ may be formed of various different materials, the most common of which would be some type of plastic. All such variations and/or modifications are intended to be covered by the following claims.

I claim:

1. An improved applicator brush apparatus for applying hair color and the like comprising:

a first handle for gripping by a user said first handle being tapered;

an applicator brush mounted to said first handle and substantially perpendicular thereto, said applicator brush including bristles for the application of hair color and the like, and a second handle, said second handle and said bristles extending in the same direction longitudinally, said first handle being substantially perpendicular to said second handle and to said bristles, said second handle being tapered, said first handle and said second handle slidably engaging one another to form a frictional connection.

2. Apparatus of claim 1 wherein said first handle includes a bore therethrough, and said applicator brush is positioned within and through said bore.

3. Apparatus of claim 2 wherein said applicator brush is mounted to said first handle via a frictional connection.

4. The apparatus of claim 3 wherein said first handle includes a thumb screw.

5. A method of applying hair color and the like to a client's scalp by utilizing an improved applicator brush, said method comprising the steps of:

sliding a tapered handle over a brush handle such that said handle and said brush handle are perpendicular to one another;

lifting and separating a section of hair using the tapered handle; and using a different portion of said applicator brush to apply said hair color without rotating said applicator brush to a new orientation.

6. The method of claim 5 wherein said applicator brush is rotated by substantially 90 degrees.

* * * * *